United States Patent [19]

Plessis et al.

[11] Patent Number: 4,675,890

[45] Date of Patent: Jun. 23, 1987

[54] X-RAY TUBE FOR PRODUCING A HIGH-EFFICIENCY BEAM AND ESPECIALLY A PENCIL BEAM

[75] Inventors: André Plessis, Clamart; Emile Gabbay, Paris, both of France

[73] Assignee: Thomson-CSF, Paris, France

[21] Appl. No.: 536,215

[22] Filed: Sep. 27, 1983

[30] Foreign Application Priority Data

Oct. 5, 1982 [FR] France ..... 82 16681

[51] Int. Cl.[4] ..... H01J 35/08; H01J 35/30

[52] U.S. Cl. ..... 378/121; 378/137; 378/143

[58] Field of Search ..... 378/121, 137, 143, 138, 378/134

[56] References Cited

U.S. PATENT DOCUMENTS

| | | | |
|---|---|---|---|
| 1,226,383 | 5/1917 | Robinson | 378/136 |
| 2,209,963 | 8/1940 | Du Mond | 378/137 |
| 2,472,745 | 6/1949 | Frevel | 378/143 |
| 2,677,069 | 4/1954 | Bachman | 378/121 |
| 2,721,954 | 10/1955 | Nygard | 378/137 |
| 2,922,060 | 1/1960 | Rajewsky | 378/143 |
| 3,584,219 | 6/1971 | Herglotz | 378/143 |
| 3,732,426 | 5/1973 | Shimizu | 378/138 |
| 3,821,579 | 6/1974 | Burns | 378/121 |
| 4,012,656 | 3/1977 | Norman et al. | 378/138 |
| 4,229,657 | 10/1980 | Bensussan et al. | 378/143 |
| 4,521,903 | 6/1985 | Braum | 378/143 |

FOREIGN PATENT DOCUMENTS

| | | |
|---|---|---|
| 241441 | 12/1911 | Fed. Rep. of Germany . |
| 2109627 | 5/1972 | France . |
| 597741 | 2/1948 | United Kingdom . |

*Primary Examiner*—Janice A. Howell

*Attorney, Agent, or Firm*—Roland Plottel

[57] ABSTRACT

An x-ray tube for producing a high-efficiency beam and especially a pencil beam as applicable to the field of radiology and more especially digital radiology comprises an anode provided with a rectilinear bore and a cathode for generating an electron beam which enters the bore. The internal walls of the bore constitute an anode target which is bombarded by the electron beam in order to produce at least one x-ray beam which emerges from one end of the bore.

7 Claims, 3 Drawing Figures

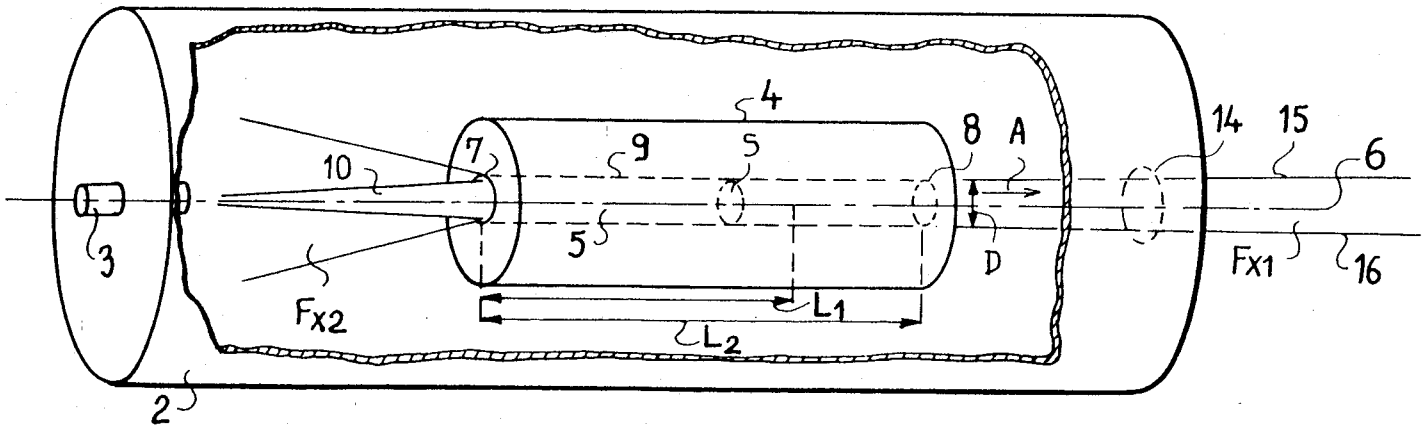
FIG_1
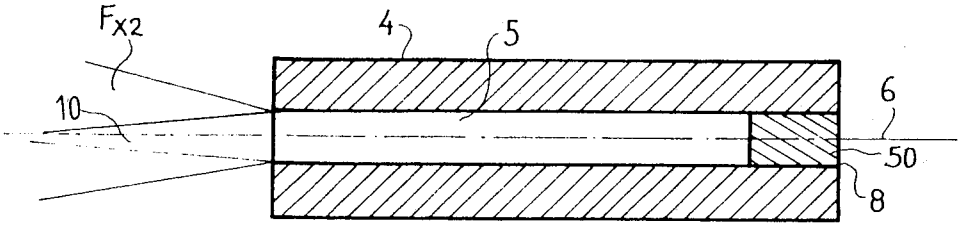
FIG_1-a

X-RAY TUBE FOR PRODUCING A HIGH-EFFICIENCY BEAM AND ESPECIALLY A PENCIL BEAM

BACKGROUND OF THE INVENTION

This invention relates to an x-ray tube for producing a high-efficiency beam, and especially a pencil beam, which is applicable to the field of radiology.

An x-ray tube usually contains an anode and an electron-emitting cathode. The electrons bombard a part of the anode which is known as the anode target and the impact of these electrons on the surface of the anode target produces a focal spot from which x-rays are emitted in all directions. If this x-radiation is limited to a given direction by means of systems for collimation either partly within the interior of the tube or outside this latter, a useful x-ray beam is thus produced and is smaller in all cases than the entire x-radiation emitted at the focal spot. Thus in the case of a radiodiagnostic tube, for example, the useful beam of x-radiation represents approximately 5% of the x-radiation emitted from the focal spot and, in the case of x-ray tubes for tomodensitometry, this percentage is of the order of 1%.

In consequence, in the case of a useful beam having a given intensity which is necessary for a given type of inspection, the electric power supplied to the tube as well as the heat loss will increase in proportion to the degree of collimation produced in order to provide the useful beam with the geometry required by the inspection operation.

By making use of an x-ray tube of conventional design, a useful beam in the form of a pencil beam can be obtained by means of strong collimation. In this case, the useful beam represents a negligible fraction of the x-radiation emitted from the focal spot in respect of a considerable amount of power consumed for the supply of said x-ray tube.

SUMMARY OF THE INVENTION

The present invention relates to a high-efficiency x-ray tube adapted to produce an x-ray beam containing a much higher proportion of the total emitted x-radiation than is the case with a conventional x-ray tube. This permits a considerable improvement in the efficiency of an installation which utilizes an x-ray tube of this type, especially in the event that the desired useful beam is in the form of a pencil beam.

In accordance with the invention, an x-ray tube for producing a high-efficiency beam and especially a pencil beam essentially comprises an anode provided with a rectilinear bore having internal walls constituting an anode target and a cathode for generating an electron beam which is directed towards the bore. Said electron beam enters a first end of the bore substantially along the axis of this latter in such a manner as to bombard said walls in order to produce at least one x-ray beam containing a high percentage of the total x-radiation, said x-ray beam being intended to emerge from one end of the bore.

We believe than an electron beam which enters one end of a rectilinear bore and bombards the internal walls of said bore at a small angle of incidence tends to promote the emission of x-radiation along an axis which is identical with that of the bore. This x-radiation can give rise to a first and to a second x-ray beam so that each beam emerges from the bore at one end of this latter. This is partly due to lower absorption of the x-rays within the wall itself, thus making it possible to obtain a greater number of x-rays which are emitted in directions parallel or nearly parallel to said axis, with the result that said x-rays are not absorbed by the walls as they follow their path prior to emergence from the bore. Furthermore, the x-ray beams thus obtained can be shaped by the bore in which they have been generated, as is especially the case with the beam which emerges from the end opposite to the electron beam inlet.

BRIEF DESCRIPTION OF THE DRAWINGS

FIG. 1 is a view in perspective showing an x-ray tube in accordance with the invention.

FIG. 1*a* is an axial sectional view showing an alternative embodiment of the anode of FIG. 1.

DESCRIPTION OF THE PREFERRED EMBODIMENT

Figure 2:
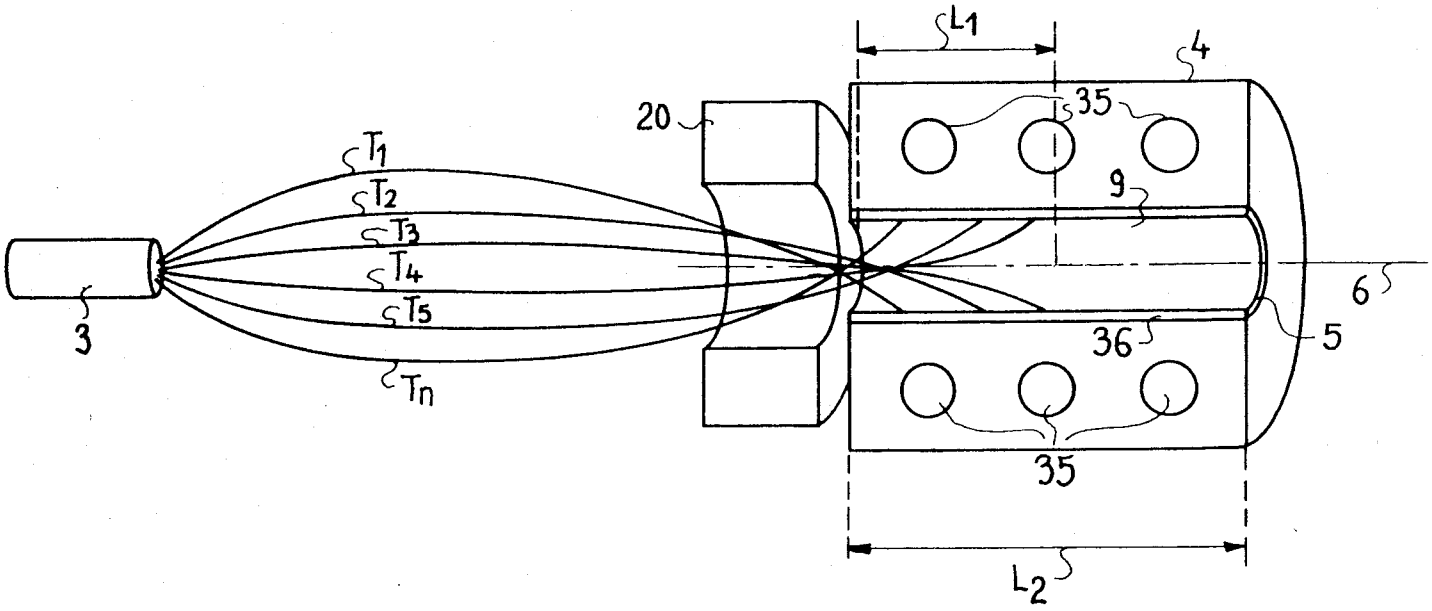
FIG. 2 shows characteristic elements of an x-ray tube in accordance with the invention in a second embodiment of said tube.

The perspective view of FIG. 1 is a schematic presentation of a x-ray tube 1 in accordance with the invention. This diagram is limited to characteristic elements located within the interior of an envelope 2 and made visible in the figure through a cut-out portion forming an opening in said envelope.

The envelope 2 supports a cathode 3, and conventional means (not shown) are employed for supporting an anode 4. In the non-limitative example of this description, said anode 4 is a cylinder provided with a bore 5 having a cross-section S which is identical throughout the length $L_2$ of said bore. Internal walls 9 of the bore 5 are thus parallel to a longitudinal axis 6 of said bore 5. In the non-limitative example herein described, the cross-section S of the bore 5 is circular and has a diameter D. The same accordingly applies to the first and second ends 7, 8 of the bore 5. In FIG. 1, the bore 5 and the second end 8 are shown in dashed lines.

The walls 9 are formed by a metal or a metallic compound which preferably has a high atomic number such as tungsten, for example.

In the non-limitative example described, the cathode 3 is located in the longitudinal axis 6 of the bore 5 and generates an electron beam 10 having axial symmetry and small divergence substantially along the longitudinal axis 6. The electron beam 10 which penetrates into the bore 5 through the first end 7 bombards the walls 9 over a length $L_1$ which, in the non-limitative example herein described, is shorter than the length $L_2$ of the bore 5, with the result that the walls 9 thus constitute an anode target. Said length $L_1$ and its position with respect to the length $L_2$ of the bore 5 are a function of the divergence of the electron beam 10, of the homogeneity of said beam, and also of the diameter D of the bore 5.

In this arrangement and taking into account the small angle of incidence (not shown) at which the electrons bombard the walls 9, said bombardment produces x-radiation having preferential emission in a direction A and constituting a first x-ray beam $Fx_1$. Said beam $Fx_1$ emerges from the second end 8 opposite to the end corresponding to entry of the electron beam 10 along an axis which is identical with the longitudinal axis 6 and passes out of the x-ray tube via an exit window 14 which is shown in dashed outline.

A noteworthy feature lies in the fact that this arrangement makes it possible in particular to obtain an x-ray beam $Fx_1$ which contains a very high proportion of the total x-radiation (not shown). Another significant feature is that, since the walls 9 are parallel, the x-ray beam $Fx_1$ is caused by the bore 5 to assume the shape of a pencil beam having limits 15, 16 which are parallel or nearly parallel to the longitudinal axis 6. The x-ray beam $Fx_1$ in the form of a pencil beam has the same cross-section S as that of the bore 5.

A fraction of the total x-radiation produces a second beam $Fx_2$ which emerges from the bore 5 via the first end 7 or in other words the end through which the electron beam 10 enters the bore.

This description of an x-ray tube in which the cathode 3 emits the electron beam 10 along the longitudinal axis 6 is not limitative. Thus the cathode 3 can be placed differently and can emit the electron beam 10 along an axis which may or may not coincide with the longitudinal axis 6. The electron beam may also not have an axis and follow a curved trajectory or any desired trajectory by making use of conventional deflecting means (not shown), the sole condition being that the electrons should arrive at the entrance or inlet of the bore 5 substantially along the longitudinal axis 6 of said bore in order to bombard the walls 9 as uniformly as possible.

In the event that only the second beam $Fx_2$ is to be utilized, the second end 8 of the bore 5 can accordingly be made opaque to x-radiation. By way of example, this can be achieved by closing said second end 8 by means of a plug (not shown) which is made of suitable material and accordingly prevents any emergence of the first beam $Fx_1$.

Similarly, the anode 4 can have a shape which is different from that shown in FIG. 1 and the same applies to the cross-section S of the bore 5. The essential condition to be satisfied lies in the need to obtain an x-ray beam $Fx_1$ in the form of a pencil beam by means of walls 9 constituted by a normed surface in which the generator-lines of said surface (not shown) are parallel to the longitudinal axis 6 of the bore 5.

The anode 4 can be formed of the same material as the walls 9 of the bore 5 as explained earlier. In this case, machining of the bore 5 results in direct formation of walls 9 which are ready to perform the function of anode target. The anode 4 can also be of different material and the walls 9 can be lined with suitable material over all or part of the length $L_2$ of the bore 5.

FIG. 1*a* is an axial crossectional view showing the anode 4. Only the second x-ray beam $FX_2$ is utilized. The second end 8 is closed by a plug 50, in order to prevent emergence of the first beam $FX_1$.

FIG. 2 represents another form of construction of an x-ray tube 1 in accordance with the invention and is an axial sectional view showing elements of said x-ray tube.

In this embodiment of the invention as well as in the example described, provision is made for an electrostatic or magnetic deflection lens 20 of conventional type. Said deflection lens is placed on the path of the electron beam emitted by the cathode 3, said electron beam being represented in FIG. 2 by electron trajectories $T_1$, $T_2$, $T_3$, $T_4$, $T_5$, . . . $T_n$. In the non-limitative example herein described, the deflection lens 20 is centered on the longitudinal axis 6 of the bore 5 and can either form part of the anode 4 itself or be located in the vicinity of this latter as in the example described.

By means of a magnetic field (not shown) produced by the deflection lens 20, said lens makes it possible to focus the electrons and to establish electron trajectories $T_1$, $T_2$, . . . $T_n$ in such a manner as to ensure that said trajectories have small angles of divergence, with the result that the electrons can pass into the bore 5 and bombard the walls 9. The beam $Fx_1$ of x-radiation (not shown in FIG. 2) is identical with the beam shown in FIG. 1.

A deflection lens 20 also makes it possible, by adjusting the strength of the magnetic field produced by said lens or by adjusting its position along the longitudinal axis 6, to adjust the length $L_1$ or distance over which bombardment of the walls 9 takes place and the position of said length $L_1$ with respect to the length $L_2$ of the bore 5. This in turn permits adjustment of the characteristics of the first beam $Fx_1$ and also of the second beam $Fx_2$ if necessary.

In the non-limitative example described, the anode 4 is of copper and is provided with passages 35 through which a coolant fluid is permitted to flow, the walls 9 being provided with a tungsten lining 36.

An x-ray tube 1 in accordance with the invention produces in particular at least one pencil beam $Fx_1$ which serves to obtain a useful beam (not shown) such that an x-radiation emission efficiency in said useful beam is increased to a very appreciable extent in comparison with traditional designs.

By virtue of its characteristics, an x-ray tube of this type is particularly well-suited to scanning techniques and primarily to digital radiology.

What is claimed is:

1. An x-ray tube for producing an x-ray beam having only slightly divergent walls, wherein said x-ray tube comprises an anode provided with a rectilinear bore having internal walls constituting an anode target, said bore having a longitudinal axis along which the beam of x-radiation is emitted, and walls which are parallel, said bore having an axial length greater than its largest cross sectional dimension, and a cathode positioned outside said bore for generating an electron beam of small divergence which is directed towards the bore, and wherein said electron beam enters a first end of the bore substantially along the axis of said bore in such manner as to bombard said walls of said bore at a small angle of incidence with respect to the generatrix of said bore and over a bombardment length which is at least an order of magnitude greater than the largest cross section dimension of said bore, the difference between the axial length of said bore and said bombardmant length being at least an order of magnitude greater than the largest cross sectional dimension of said bore, and positioned more remote from said cathode than said bombardment length, in order to produce at least one x-ray beam containing a high percentage of the total x-radiation, said x-ray beam being intended to emerge from one end of said bore.

2. An x-ray tube according to claim 1, wherein the bore has an identical cross-section throughout its length in order to obtain a beam of x-radiation in the form of a pencil beam.

3. An x-ray tube according to claim 1, wherein the cathode is located in the longitudinal axis of the bore and generates the electron beam along said axis.

4. An x-ray tube according to claim 1, wherein a second beam of x-radiation emerges from the bore via the first end of said bore.

5. An x-ray tube according to claim 1, wherein the beam of radiation which is more particularly utilized is the first beam which emerges from the bore via the second end opposite to the end corresponding to entry of the electron beam.

6. An x-ray tube according to claim 4, wherein a single beam of radiation constituted by the second beam emerges from the bore by virtue of the fact that the second end is closed.

7. An x-ray tube according to claim 1, wherein said tube further comprises a deflection lens located on the path of the electron beam in order to focus the electrons and to define electron trajectories having small divergence in order to enter the bore.

* * * * *